US005700301A

United States Patent [19]

Ahmed

[11] Patent Number: 5,700,301

[45] **Date of Patent: *Dec. 23, 1997**

[54] FUEL ADDITIVES AND METHOD

[75] Inventor: Syed Habib Ahmed, London, Great Britain

[73] Assignee: Chemadd Limited, London, England

[ * ] Notice: The term of this patent shall not extend beyond the expiration date of Pat. No. 5,538,522.

[21] Appl. No.: 641,189

[22] Filed: Apr. 30, 1996

Related U.S. Application Data

[63] Continuation of Ser. No. 266,955, Jun. 27, 1994, Pat. No. 5,538,522.

[30] Foreign Application Priority Data

Jun. 28, 1993 [GB] United Kingdom ..... 9313326

[51] Int. Cl.[6] ..... C10L 1/22

[52] U.S. Cl. ..... 44/412; 44/432; 44/436; 44/451

[58] Field of Search ..... 44/412, 432, 436, 44/451

[56] References Cited

U.S. PATENT DOCUMENTS

| | | | |
|---|---|---|---|
| 3,920,698 | 11/1975 | Haemmerle et al. | 260/326.5 FM |
| 3,927,994 | 12/1975 | Romans . | |
| 3,927,995 | 12/1975 | Romans . | |
| 3,980,448 | 9/1976 | Haemmerle et al. . | |
| 4,011,057 | 3/1977 | Sayers . | |
| 4,081,252 | 3/1978 | Osborg . | |
| 4,197,081 | 4/1980 | Osborg | 431/2 |
| 4,235,811 | 11/1980 | Schulze et al. | 260/513 N |
| 4,244,703 | 1/1981 | Kaspaul . | |
| 4,298,708 | 11/1981 | Schulze et al. | 521/115 |
| 4,304,690 | 12/1981 | Schulze et al. | 252/526 |
| 4,328,004 | 5/1982 | Globus | 44/412 |
| 4,330,304 | 5/1982 | Gorman . | |
| 4,397,654 | 8/1983 | 'T Hart | 44/412 |
| 4,424,063 | 1/1984 | 'T Hart . | |
| 4,568,358 | 2/1986 | Courtney . | |
| 4,997,594 | 3/1991 | Walsh | 252/51.5 A |
| 5,004,479 | 4/1991 | Schon et al. | 44/302 |
| 5,141,524 | 8/1992 | Gonzalez | 44/340 |
| 5,197,997 | 3/1993 | Mozdzen et al. | 44/386 |
| 5,340,488 | 8/1994 | Adams | 44/432 |

FOREIGN PATENT DOCUMENTS

| | | |
|---|---|---|
| 0167358 | 1/1986 | European Pat. Off. . |
| 1437041 | 3/1966 | France . |
| 2084614 | 11/1971 | France . |
| 0870725 | 6/1961 | United Kingdom . |
| 0990797 | 5/1965 | United Kingdom . |
| 2085468 | 4/1982 | United Kingdom . |
| 8201717 | 5/1982 | WIPO . |

*Primary Examiner*—Jacqueline V. Howard
*Assistant Examiner*—Cephia D. Toomer
*Attorney, Agent, or Firm*—White & Case

[57] ABSTRACT

Disclosed are additives for fuel which comprise certain aliphatic amines and aliphatic alcohols in a paraffin carrier such as kerosene. The additives improve combustion efficiency and fuel economy, and reduce the amount of pollutants and corrosives formed in the combustion process.

5 Claims, 14 Drawing Sheets

FUEL ADDITIVES AND METHOD

CROSS REFERENCE TO RELATED APPLICATIONS

This application is a continuation of U.S. Ser. No. 08/266,955, filed on Jun. 27, 1994, now U.S. Pat. No. 5,538,522.

BACKGROUND OF THE INVENTION

This invention generally relates to the field of fuel additive compositions and, more specifically, to fuel additive compositions capable of increasing the efficiency of combustion systems i.e. continuous combustion systems (boilers, furnaces etc.) and internal combustion systems (vehicles etc.) thereby increasing fuel economy, decreasing the amount of harmful pollutants formed in the combustion process, reducing the corrosive effects of fuels, and reducing engine noise and roughness.

In recent years, there has been an increased awareness of the need for greater fuel efficiency and maximum pollution control from combustion of fossil fuels. Fuel additives have long been employed to provide a variety of functions in fuels intended for use in combustion systems, and have demonstrated varying degrees of effectiveness. For example, Kaspaul describes in U.S. Pat. No. 4,244,703 the use of diamines, especially tertiary diamines, with alcohols as fuel additives to, primarily improve the fuel economy of internal combustion engines. Similarly, Metcalf describes in GB 0990797 the use of an admixture comprising formaldehyde or polymeric formaldehyde, a combined acrylic ester and acrylic resin solution, methylene glycol dimethyl ether, propanediamine, and butyl-paraphenylene diamine in a carrier or solvent as a fuel additive primarily intended to improve the fuel economy of internal combustion engines. The fuel additives described by Knight in GB 2085468 comprising aliphatic amines and aliphatic alcohols serve as anti-misting additives for aviation fuels while GB 0870725 describes the use of N-alkyl substituted alkylene diamines as anti-icing agents. Only a few of those compositions either claimed to or actually do improve combustion efficiency, but none have proved completely successful. Furthermore, none of the known compositions have been able to successfully fill the need for fuel additives which, when added to fuels, provide greater fuel efficiency, maximum pollution control, and reduction of the corrosive effects of fuels on combustion systems.

The need to reduce the amount of harmful pollutants formed in the combustion process is great. On complete combustion, hydrocarbons produce carbon dioxide and water vapor. However, in most combustion systems the reactions are incomplete, resulting in unburned hydrocarbons and carbon monoxide formation which constitutes a health hazard. Moreover, particulates may be emitted as unburned carbon in the form of soot. Sulphur (S), the major fuel impurity is oxidized to form sulphur dioxide ($SO_2$) and some is further oxidized to sulphur trioxide ($SO_3$). Furthermore, in the high temperature zones of the combustion system, atmospheric and fuel bonded nitrogen is oxidized to nitrogen oxides, mainly nitrogen oxide (NO) and nitrogen dioxide ($NO_2$). All these oxides are poisonous or corrosive. When oxidized in the combustion zone, nitrogen and sulphur form NO, $NO_2$, $SO_2$ and $SO_3$. $NO_2$ and $SO_3$ are the most harmful of these oxides.

Pollutants also arise due to incomplete combustion of the fuel, these being particulates, hydrocarbons and some carbon monoxide. The desired goal of reducing the amounts of both groups of pollutants is very difficult to achieve due to the mutually contradictory nature of the formation of these pollutants. Nitrogen and sulphur oxides require a depletion of oxygen or, more specifically atomic oxygen, to prevent further oxidation to the higher more deleterious oxides; and the particulates require an abundance of oxygen to enable complete oxidation of the unburned fuel.

It is believed that anything which can mop up atomic oxygen will reduce formation of the higher oxides of nitrogen and sulphur. It is well known that atomic oxygen is responsible for the initial oxidation of $SO_2$ to $SO_3$ within the reaction zone. Therefore any reduction in atomic oxygen will lead to a reduction of $SO_3$ and $NO_2$.

The oxides produced during combustion have a deleterious effect on biological systems and contribute greatly to general atmospheric pollution. For example, carbon monoxide causes headaches, nausea, dizziness, muscular depression, and death due to chemical anoxemia. Formaldehyde, a carcinogen, causes irritation to the eye and upper respiratory tract, and gastrointestinal upsets with kidney damage. Nitrogen oxides cause bronchial irritation, dizziness, and headache. Sulphur oxides cause irritation to mucous membranes of the eyes and throat, and severe irritation to the lungs.

In addition to contributing to air pollution, combustion by-products, especially sulphur (S), sodium (Na) and vanadium (V), are responsible for most of the corrosion which is encountered in continuous combustion systems. These elements undergo various chemical changes in the flame, upstream of the corrosion susceptible surface.

During combustion, all the sulphur is oxidized to form either $SO_2$ or $SO_3$. The $SO_3$ is of particular importance from the point of view of plant and engine corrosion. The $SO_3$ combines with $H_2O$ to form sulfuric acid, $H_2SO_4$ in the gas stream and may condense out on the cooler surfaces (100° C. to 200° C.) of air heaters and economizers, causing severe corrosion of these parts. The formation of $SO_3$ also causes high temperature corrosion.

$SO_3$ formation most probably occurs via the reaction of $SO_2$ with atomic oxygen. The oxygen atom being formed either by the thermal decomposition of excess oxygen, or the dissociation of excess oxygen molecules by collision with excited $CO_2$. molecules which exists in the flame:

$$CO+O \rightarrow CO_2^*$$

$$CO_2^*+O_2 \rightarrow CO_2+2O$$

The residence time of bulk flue gases within a continuous combustion system is normally insufficient for the $SO_3$ concentration to approach its equilibrium level, most of the $SO_3$ present originating in the flame. The net result is that the steady state $SO_3$ concentration in the flue gas is normally of the same order as, but slightly less than, that generated in the flame. Therefore, it is essential to reduce $SO_3$ concentrations in the flame. To achieve this, excess oxygen concentrations must be minimized. However, reduction of oxygen also leads to incomplete combustion and particulate and smoke formation. To achieve this balance is extremely difficult in large continuous combustion systems and, therefore, a fuel additive which could manipulate the combustion reactions to reduce $SO_3$ formation without incurring increased soot and particulate penalties would be highly desirable.

Compared with sulphur, the behavior of sodium and vanadium are more complex. The sodium in oil is mainly in the form of NaCl and is vaporized during combustion. Vanadium during combustion forms VO and $VO_2$ and, depending on the oxygen level in the gas stream, forms higher oxides, the most harmful of which is vanadium pentoxide ($V_2O_5$). $V_2O_5$ reacts with NaCl and NaOH to form sodium vanadates. Sodium reacts with $SO_2$ or $SO_3$, and $O_2$ to form $Na_2SO_4$.

All these condensed compounds cause extensive corrosion and fouling of the combustion system. The degree of fouling and corrosion is dependent on a number of variables and occur to different extent at different locations in the combustion system.

One of the most important pollutants formed by oil combustion is oil-ash, which in the presence of $SO_3$ forms complex, low melting point, vanadyl vanadates, for instance $Na_2O.V_2O_4.5V_2O_5$ and the comparatively rare 5-sodium-vanadyl 1.11-vanadate ($5Na_2O.V_2O_5.11V_2O_5$). Thus, high temperature corrosion can occur when the melting point of these substances are exceeded since most protective metal oxides are soluble in molten vanadium salts.

These observations have lead to a variety of proposals for minimizing corrosion. The known techniques have their advantages and disadvantages but none have been able to fill the need for fuel additives which are commercially viable and minimize corrosion without undesirable side effects. However, it is known that if $SO_3$ formation could be suppressed, $V_2O_5$ and other harmful by-products would be minimized inherently.

It will be appreciated that it is very difficult to establish the characteristics which are likely to enhance combustion of the fuel because of the very rapid and complex nature of the combustion process. Not surprisingly, numerous theories have been put forward for the combustion process, some of which conflict with one another.

It is convenient to split the combustion process into three distinct zones, namely a preheat zone, the true reaction zone and a recombination zone. With the majority of hydrocarbons, in the preheat zone degradation occurs and the fuel fragments leaving the zone will generally comprise mainly lower hydrocarbons, olefins and hydrogen. In the initial stages of the reaction zone the radical concentration will be very high and oxidation will proceed mainly to CO and OH. The mechanism by which CO is then converted into $CO_2$ during combustion has been the subject of controversy for many years. However, it is believed that the nature of the species in the true reaction region is critical for the oxidation. In this region many species are competing for the available atomic oxygen, including CO, OH, NO and $SO_2$. Compared with the many transient species present in the initial stages of a flame, the concentration of CO, NO and $SO_2$ is large. CO and OH will readily react with oxygen radicals to form $CO_2$ and $H_2O$ and the oxidation of these can be complete in the initial stages of the flame. If initiation of reaction occurs near the beginning of the reaction zone this will allow the OH and CO species greater time to react with the available oxygen radicals. This will ensure that the duration of time spent by the species within the reaction zone is increased and therefore greater completion of the combustion reaction occurs.

From this theory it will be appreciated that if additives can be found which shorten the ignition delay this will, in turn, initiate early reaction thus allowing greater time of OH and CO to react. In doing so, OH and CO compete with $SO_2$ and NO for the available atomic oxygen in the true reaction region.

The fuel additives of the present invention increase the operating efficiency of combustion systems by reducing the ignition delay of fuels and thereby improving the combustion characteristics of a system in which the given fuel is burned. The present additives initiate and quicken the ignition process thereby providing improvements in the combustion process resulting in reduced emissions of harmful pollutants, increased fuel economy, reduced corrosive effects on the system, and reduced engine noise and roughness in the case of internal combustion systems.

SUMMARY OF THE INVENTION

The present invention provides fuel additives which improve the combustion process of fossil fuel in combustion systems. A particular use of these additives is for increasing the efficiency of the combustion and the reduction of harmful pollutants emitted from combustion systems i.e. continuous combustion systems (boilers, furnaces etc.) and internal combustion systems (vehicles etc.). An additional particular use of the present additive is in reducing the corrosive effects of combustion by-products on the combustion system. The fuel additives of the invention shorten the ignition delay of the fuel and bind to atomic oxygen resulting in reduced emissions of harmful pollutants as well as increased combustion system efficiency.

According to the present invention there is provided a fuel additive which comprises a liquid solution in a paraffin or mixture of paraffins having a boiling point no greater than about 300° C. of an aliphatic amine and an aliphatic alcohol. The amine and the alcohol are selected from those having a boiling point less than that of the paraffin or mixture of paraffins.

The present invention provides two modes of action for increasing fuel efficiency and decreasing the deleterious compounds of the combustion reaction. The first mode of action is to shorten the ignition-delay time for reaction, thereby allowing a greater reaction residence time for the CO species to react with atomic oxygen to form $CO_2$. The second mode of action is to bind with the atomic oxygen thereby reducing its availability in the critical reaction zone to NO, $SO_2$ species and formation of its higher oxides. It is believed that these modes of action occur by the breakdown of the additive of the present invention in the flame zone to provide radicals that react with atomic oxygen and thereby reduce its concentration in the high temperature flame zone. In consequence less $SO_3$ and $NO_2$ is formed. This reduction in atomic oxygen concentration is disadvantageous for combustion but this is counter balanced by initiating the start of combustion earlier. As a result, the products of incomplete combustion have a greater probability of reaction to form oxidized species. Since these oxidation reactions are faster than the oxidation of $SO_2$ or NO they take preference in the early stages of combustion.

DESCRIPTION OF THE PREFERRED EMBODIMENTS

Figure 1:
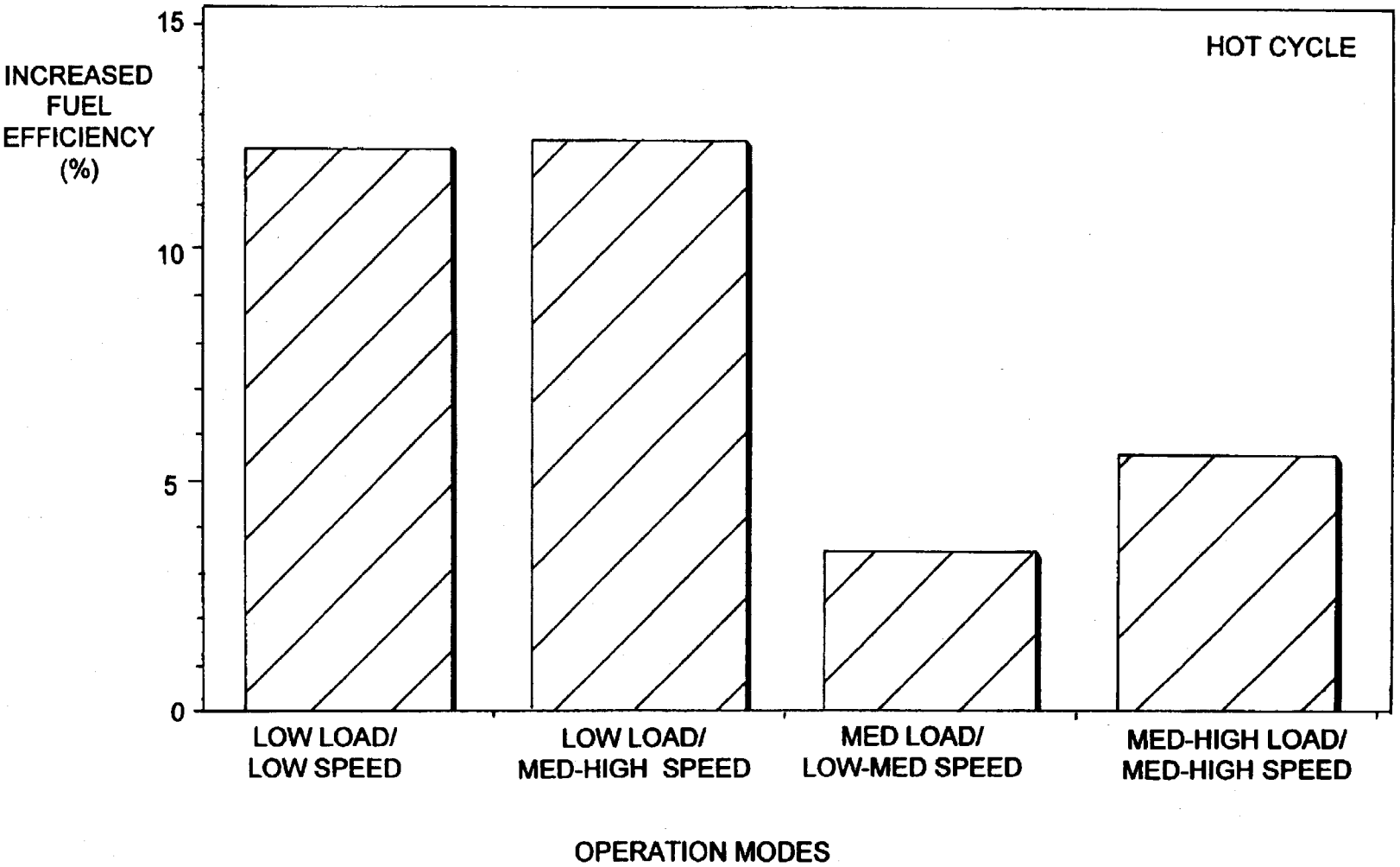
FIG. 1 Graphical representation of the fuel efficiency of the additive fuel to neat fuel during hot start-up engine operations at low load/low speed, low load/medium-high speed, medium load/low-medium speed, and medium-high load/medium-high speed.

The aliphatic amine used in the present invention is typically a monoamine or a diamine, which is typically primary or secondary. It will generally have 3 to 8, especially 3 to 6, carbon atoms. The number of nitrogen atoms will generally not exceed 2. Preferred amines include secondary monoamines and primary diamines. A diisobutylamine. Other suitable monoamines such as include isopropyl amine and tertiary butyl amine may also be employed. These amines will typically have a boiling point from 25° to 80° C., more preferably from 40° to 60° C. but this will depend to some extent on the kerosine which generally has a boiling point no greater than 200° C. and preferably no greater than 160° C. A particularly preferred diamine is 1,3-diaminopropane. While the monoamines or diamines useful in the invention can be used alone as fuel additives, it is preferred that the monoamines or diamines be mixed with an aliphatic alcohol. The aliphatic alcohol employed will generally have 5 to 10 carbon atoms, preferably 5 to 8 carbon atoms. A preferred material is isooctyl alcohol but lower homologues can also be employed.

It is believed that the presence of the amine and alcohol will affect the atomic oxygen present in the initial stages and thereby affect the conversion of $SO_2$ to $SO_3$. Surprisingly, the presence of nitrogen containing compounds does not generally increase the emission of nitrogen oxides ($NO_x$) as might have been expected. In addition, it is believed that the presence of amine helps to reduce corrosion.

The aliphatic amine/aliphatic alcohol mixture can further be admixed with an aliphatic ketone. Although this is not essential, the addition of an aliphatic ketone helps to enhance the production of CO thereby reducing the amount of $NO_x$ produced. Typical ketones for this purpose include ethyl amyl ketone and methyl isobutyl ketone.

The admixture of aliphatic amine, aliphatic alcohol, aliphatic ketone can further be admixed with a paraffinic carrier. The paraffin will typically be kerosine which acts as a carrier for the other ingredients although diesel or spindle oil, for example, can also be used. It has been found that the addition of n-hexane and 2,2,4-trimethyl pentane, in particular, enhance the properties of the kerosine. The presence of n-hexane will improve the solvent properties of the kerosine in cleaning the combustion chamber and reducing waxing. Other paraffins can, of course, be employed including n-heptane and 3- and 4-methylheptane.

In general the paraffin component will represent at least 40% by volume of the formulation and preferably from 60 to 95%. Apart from kerosine, the addition of other paraffins typically accounts from 2.5 to 20%, and preferably from 7 to 15%, by volume of the formulation. The amine is generally present in an amount from 2.5 to 20% by volume and preferably from 7 to 15% by volume while the amount of alcohol present is generally from 2.5 to 20%, preferably from 5 to 10% by volume of the formulation. The amount of monoamine will generally be from 1 to 5%, preferably from 2 to 3%, of the total volume. The ketone will generally be present in an amount from 0 to 7.5%, preferably from 1 to 5% and more particularly from 1 to 3% by volume of the formulation. Preferred formulations include a mixture of n-hexane, 2,2,4-trimethyl pentane and kerosine as paraffin, and/or a mixture of diisobutyl amine and 1,3-diaminopropane as amine and/or isooctyl alcohol as alcohol and ethyl amyl ketone as optional ketone. A particularly preferred formulation is presented in Table 1 below:

TABLE 1

| Additive | % by volume |
|---|---|
| n-hexane | 7.08 |
| diisobutylamine | 2.83 |
| ethyl amyl ketone | 2.12 |
| 2,2,4-trimethyl pentane | 2.97 |
| isooctyl alcohol | 7.08 |
| kerosine | 70.82 |
| 1,3-diaminopropane | 7.08 |

In addition to the additive itself, an aspect of the invention is a fuel containing the additive. Thus the additive may be included by the supplier or the additive may be supplied in a package to be incorporated at a later stage, for example at the retail site. In general the additive will be employed at a treat rate of from 1:100 to 1:10,000 and preferably 1:500 to 1:2,000 parts by volume of fuel, depending on the nature of the fuel and the conditions e.g. corrosion inhibition, that is desired. Of course, if the additive is made more concentrated (by using less paraffin) lower treat rates can be used.

EXAMPLE 1

In this example, the fuel additive having the preferred formulation set out in Table 1 and commercial diesel fuel were mixed at a treat rate of 1:1,000 parts by volume and were compared with neat commercial diesel fuel in engine tests conducted in accordance with the procedure used in the United States of America for the certification of diesel engines (Appendix 1 (f)(2) of the Code of Federal Regulations 40, Part 86). These tests are based on real driving patterns observed in the United States of America. Rates of emission of carbon monoxide, carbon dioxide, volatile hydrocarbons and oxides of nitrogen were recorded at one second intervals continuously throughout the test. In addition, particulate mass emissions were monitored continuously and the fuel efficiency was also determined. The chosen procedure was particularly suitable for a comparative study since the engine was operated under computer control which gave excellent repeatability.

Four tests were conducted with the engine operated from a cold start with and without the fuel additive and then from a hot start with and without the fuel additive. The sulphur trioxide tests were conducted on a continuous combustion chamber.

Measurements were carried out conforming with the requirements of the test. Gaseous emissions were measured as follows:

(1) Flame Ionization Detector (FID) for total hydrocarbons (THC)

(2) Chemiluminescent analyzer for NO/NOx (3) Non-dispersive infrared (NDIR) gas analyzer for $CO_2$ (4) Non-dispersive infrared (NDIR) gas analyzer for CO (5) Wet chemical titration method for sulphur trioxide The tests were conducted on:

(1) Volvo TD 71 FS engine (2) Single cylinder, four cycle, compression-ignition, airless fuel injection Gardner oil engine.

(3) Continuous combustion chamber. Chamber modelled on the conditions prevailing in a diesel fired power generator.

During the tests, a range of operating parameters in exhaust emission rates (a total of 13 variables) were recorded once a second, providing a continuous record of the results. Since the test has a duration of 20 minutes, each test produced a very large number of data. To provide a clear picture of the results, the data has been presented at various load-speed conditions. This allows for the determination of the effect of the additive at the required condition.

1. Efficiency Test

Figure 2:
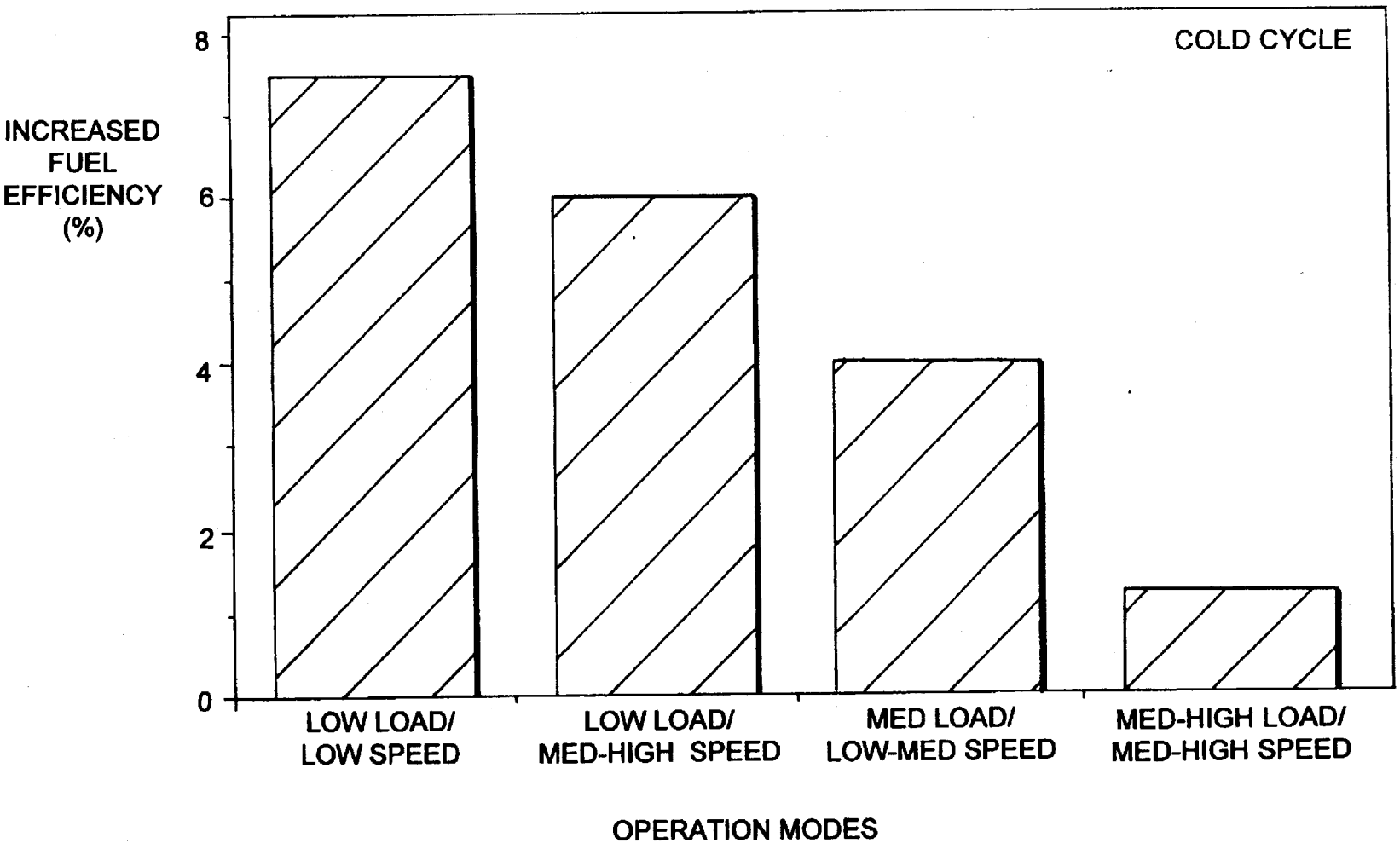
FIG. 2 Graphical representation of the fuel efficiency of the additive fuel to neat fuel during cold start-up engine operations at low load/low speed, low load/medium-high speed, medium load/low-medium speed, and medium-high load/medium-high speed.

FIGS. 1 and 2 compare respectively the fuel efficiency of the additive fuel to neat fuel for hot and cold start-up. These values have been obtained by calculating the increase in the CO and $CO_2$ levels and the decrease in the hydrocarbon and particulate levels, obtained with the use of the fuel additive. The calculation involves determining the enthalpy of formation of these compounds and comparing this energy to the amount of diesel needed to supply the same amount of energy when burned. Although, this does not strictly represent the actual fuel efficiency, it nevertheless, gives an indication as to what fuel savings may be achieved. This is a reasonable assumption, since any reduction in hydrocarbon emissions or particulates must represent itself in an increase in the amount of fuel burned and hence extra efficiency. A significant increase in the fuel efficiency occurred with the use of the fuel additive. This increase occurred when the additive had just been mixed with the fuel and if the effect of the additive is cumulative the increase in fuel efficiency is expected to rise still further. On a less technical note, the performance of the engine was 'heard' to be smoother and quieter indicating greater efficiency and longer life-time with possible less maintenance. Although, fluctuations in fuel efficiency did occur, the overall increase for the whole cycle was in excess of 8% for the hot start-up and 5% for a cold start-up. The effect of the additive will obviously depend on the operating conditions and on the state of the engine.

2. Hydrocarbons

Figure 3:
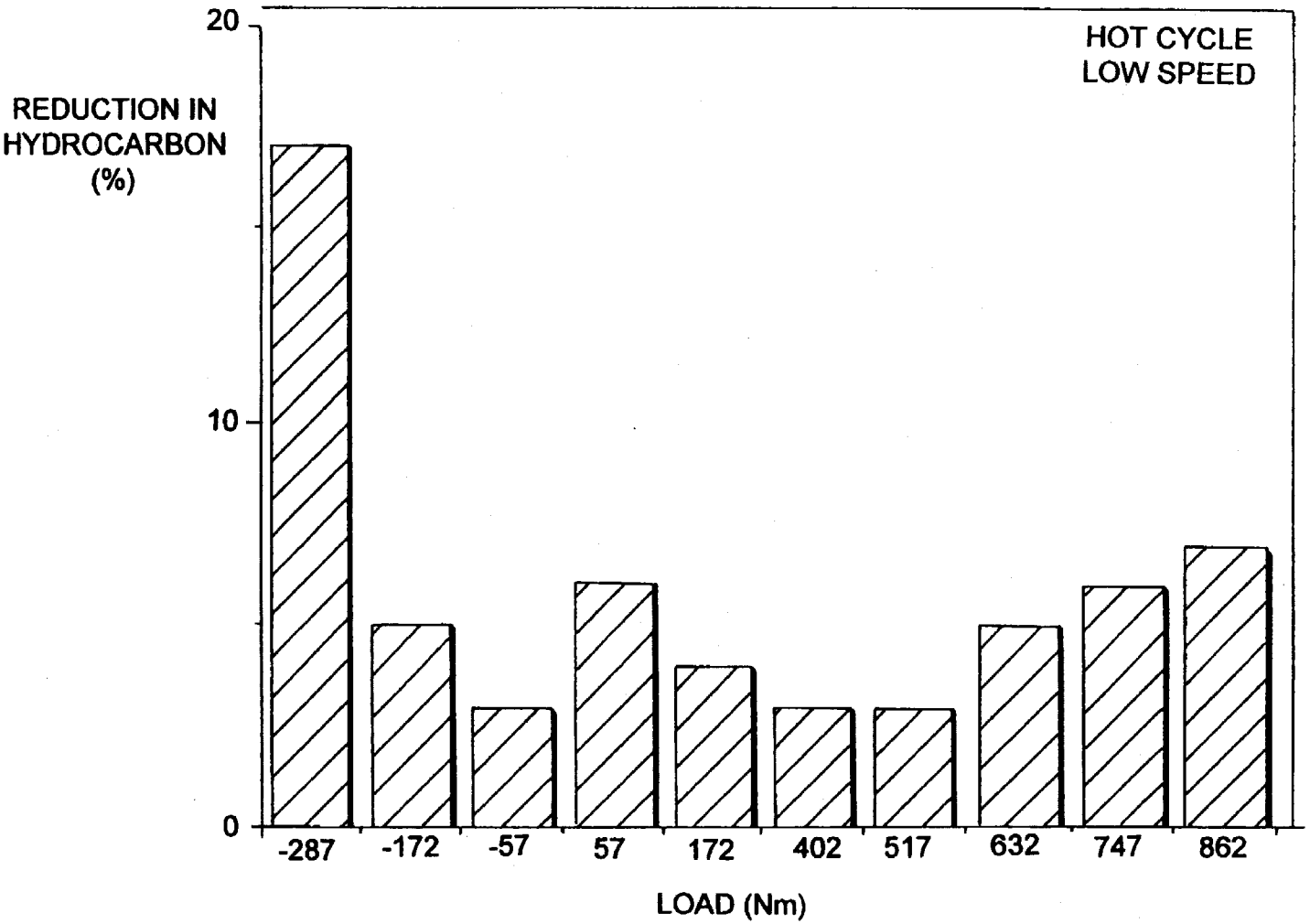
FIG. 3 Graphical representation of the effects of the additive on the reduction of hydrocarbons during hot cycle, low speed engine operations.
Figure 4:
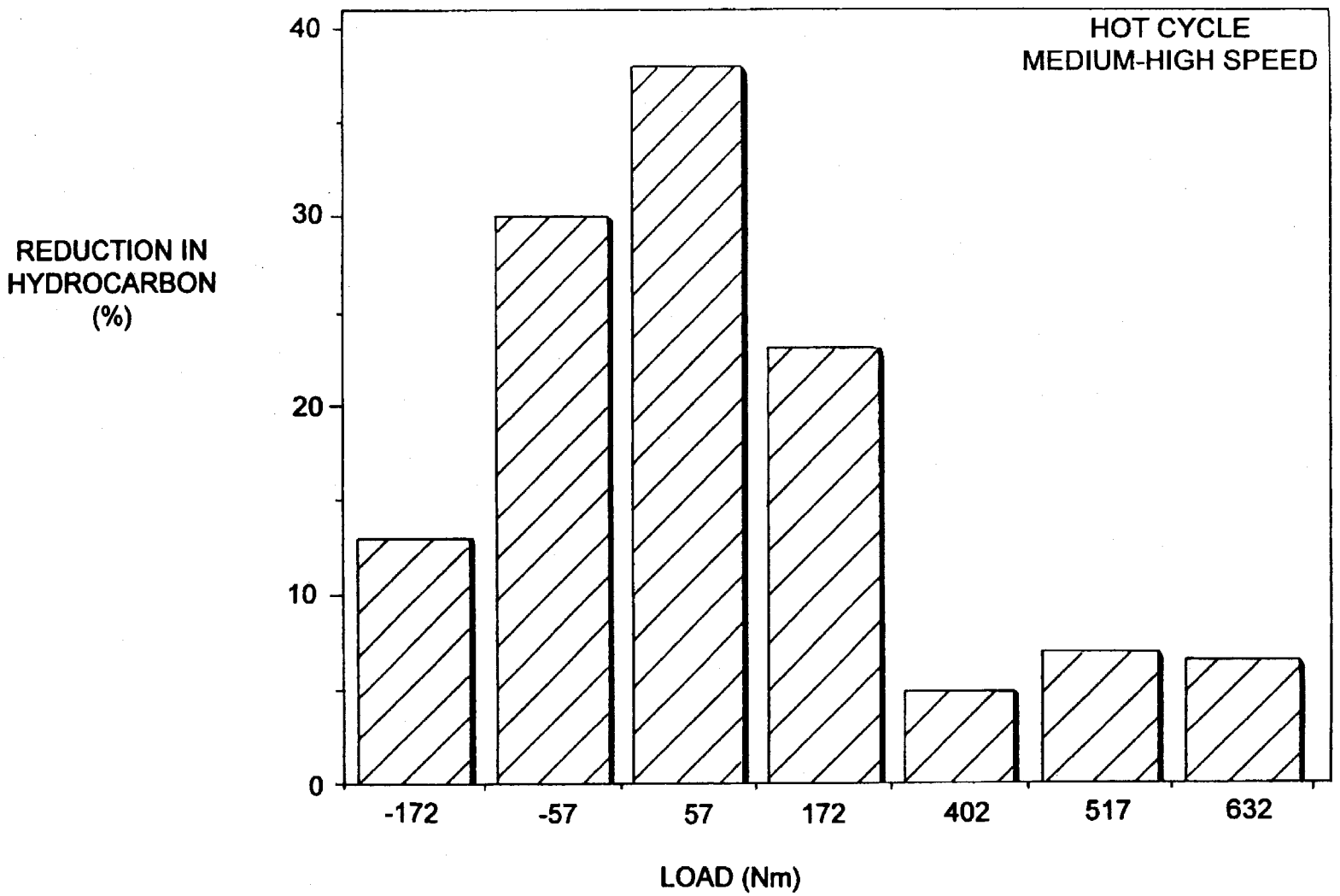
FIG. 4 Graphical representation of the effects of the additive on the reduction of hydrocarbons during hot cycle, medium-high speed engine operations, FIG. 5 Graphical representation of the effects of the additive on the reduction of hydrocarbons during cold cycle engine operations.
Figure 5:
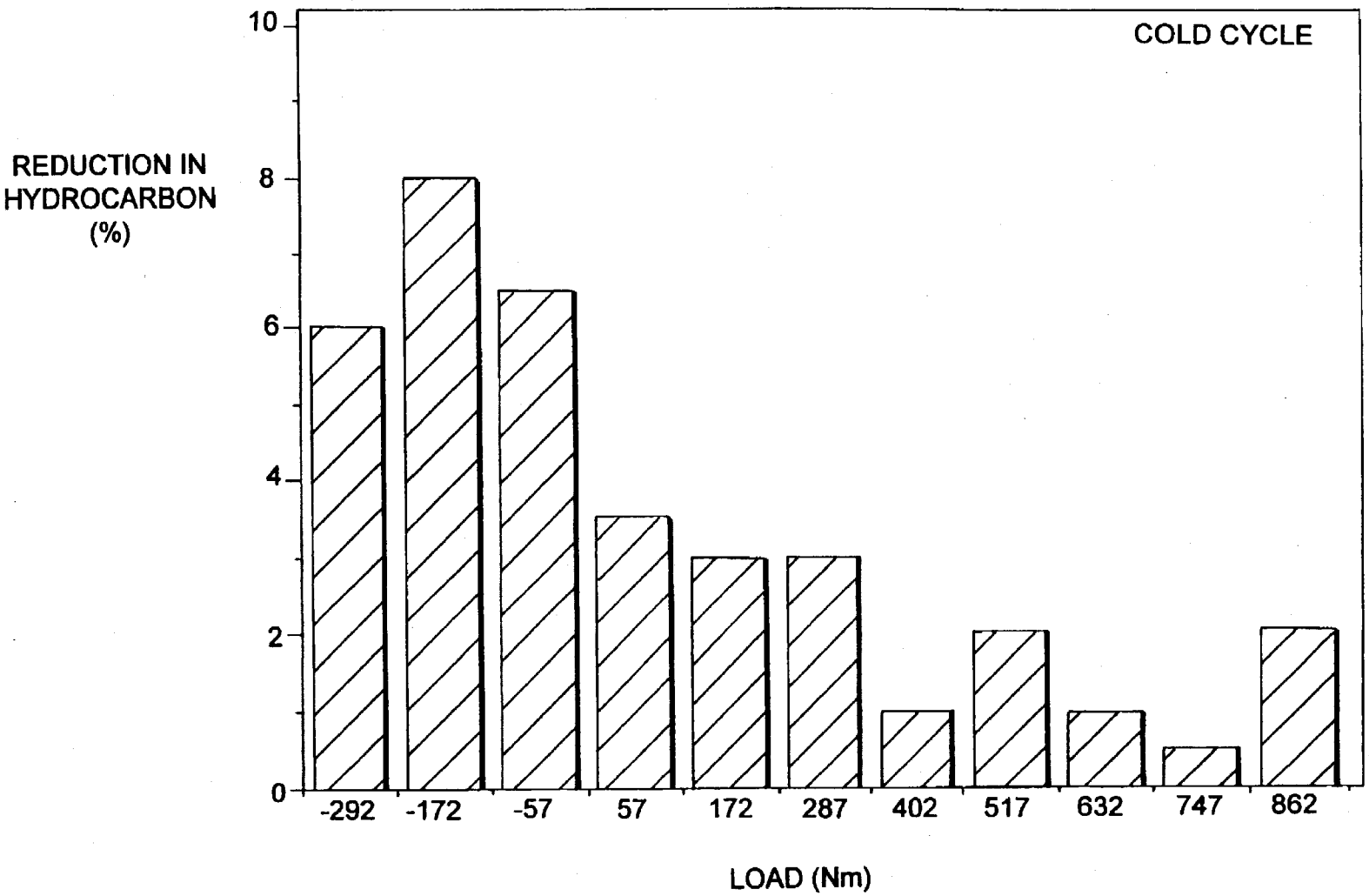

FIGS. 3, 4 and 5 show the effect of the additive on the reduction of hydrocarbons. The hot cycle graph is presented at low-medium speed vs. load and medium-high speed vs. load for greater clarification. The additive clearly reduces unburned hydrocarbons. This is to be expected if, as seen previously, the fuel efficiency increases. Reductions in unburned hydrocarbons indicate greater utilization of the fuel and therefore greater fuel efficiency. Another beneficial aspect of this reduction is on the improvement of the environment. Unburned hydrocarbons are known to be carcinogenic and therefore any reduction is desirable.

3. Particulates

Figure 6:
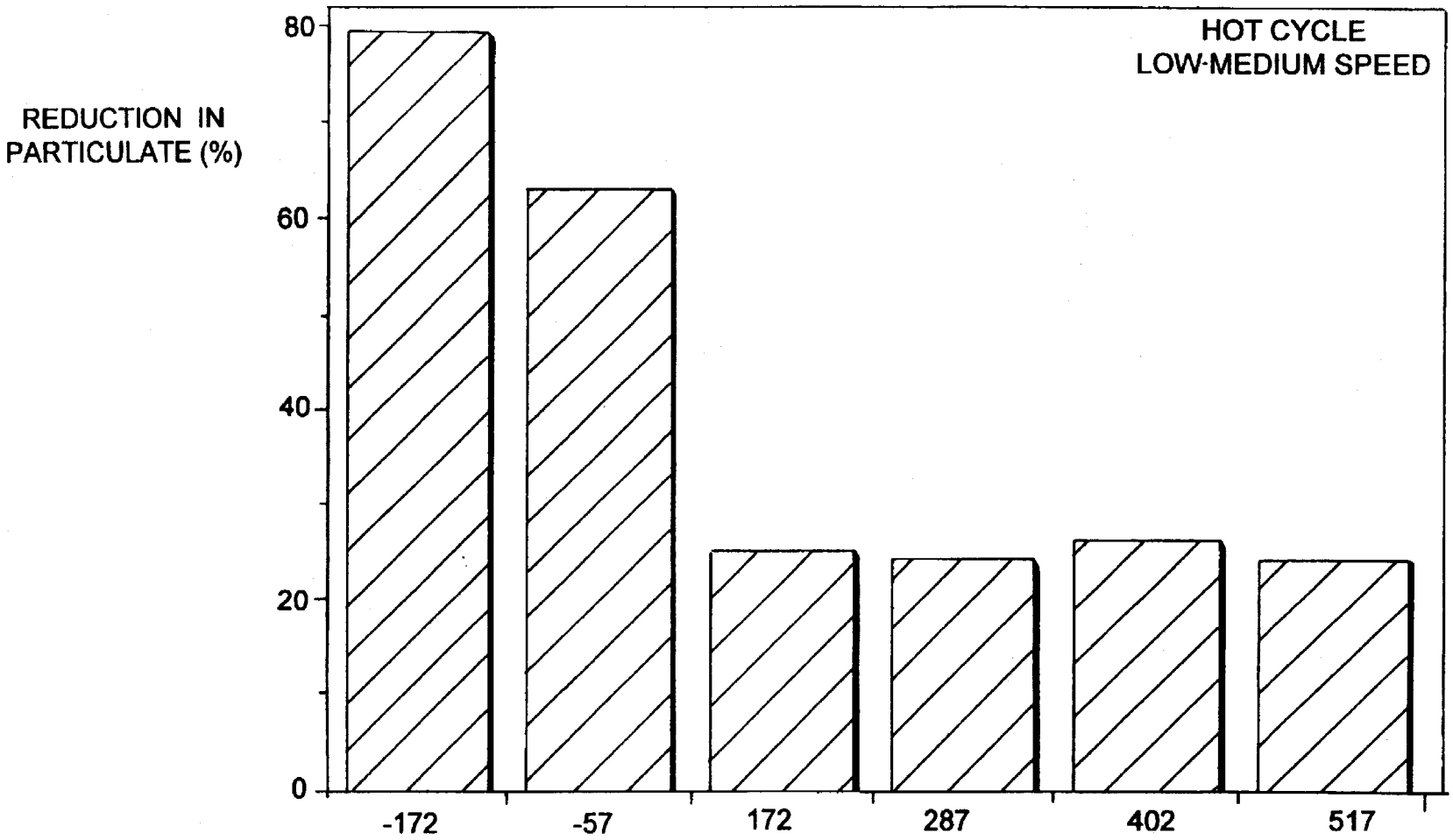
FIG. 6 Graphical representation of the effects of the additive on the reduction of particulates during hot cycle, low-medium speed engine operations.
Figure 7:
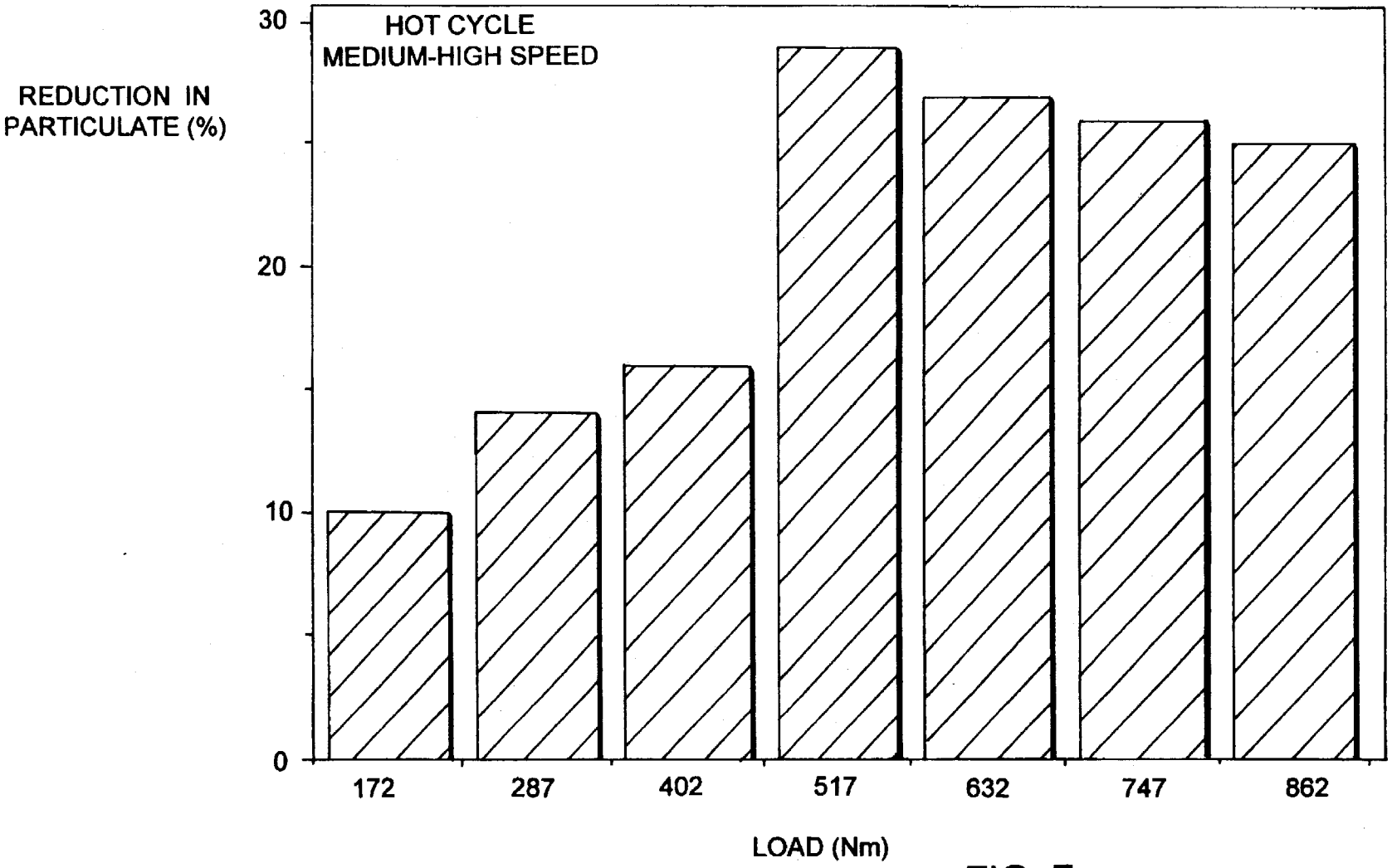
FIG. 7 Graphical representation of the effects Of the additive on the reduction of particulates during hot cycle, medium-high speed engine operations.
Figure 8:
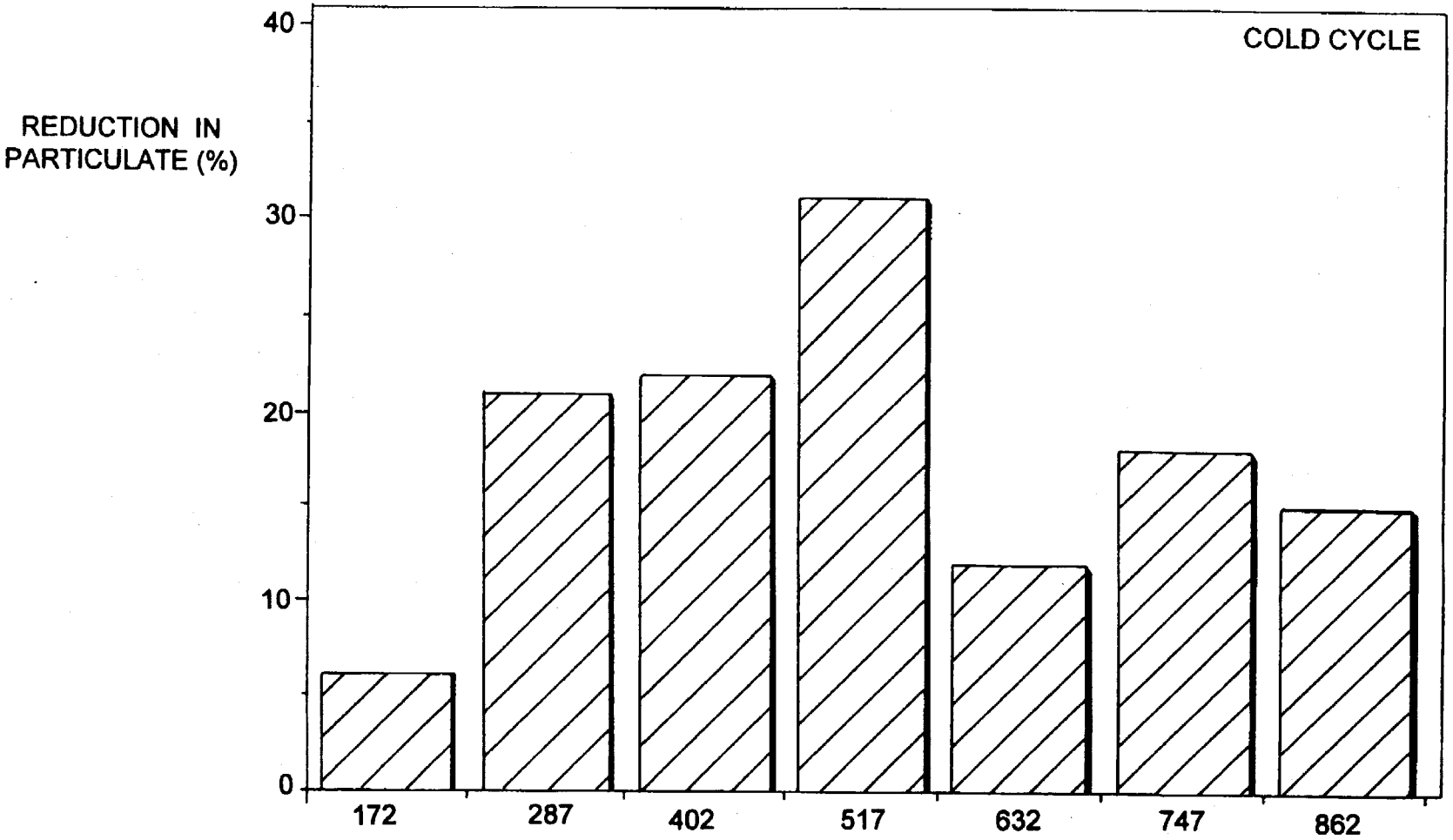
FIG. 8 Graphical representation of the effects of the additive on the reduction of particulates during cold cycle engine operations.

Large reductions in the amount of particulates occurred with the additive treated fuel. FIGS. 6, 7 and 8 represent these results. The extraordinary large decrease shown in FIG. 6 for loads of −172 Nm and −57 Nm are very remarkable but probably not representative of normal operations. Under normal operating conditions the decrease was of the order of 20–30%. This reduction, in itself, is quite significant and represents a major contribution to the reduction of atmospheric pollution. The problem of particulate emissions has reached such a serious environmental and political situation that both the European Community and the USA are due to pass binding legislation for the reduction of this pollutant.

4. Nitrogen Oxides

Figure 9:
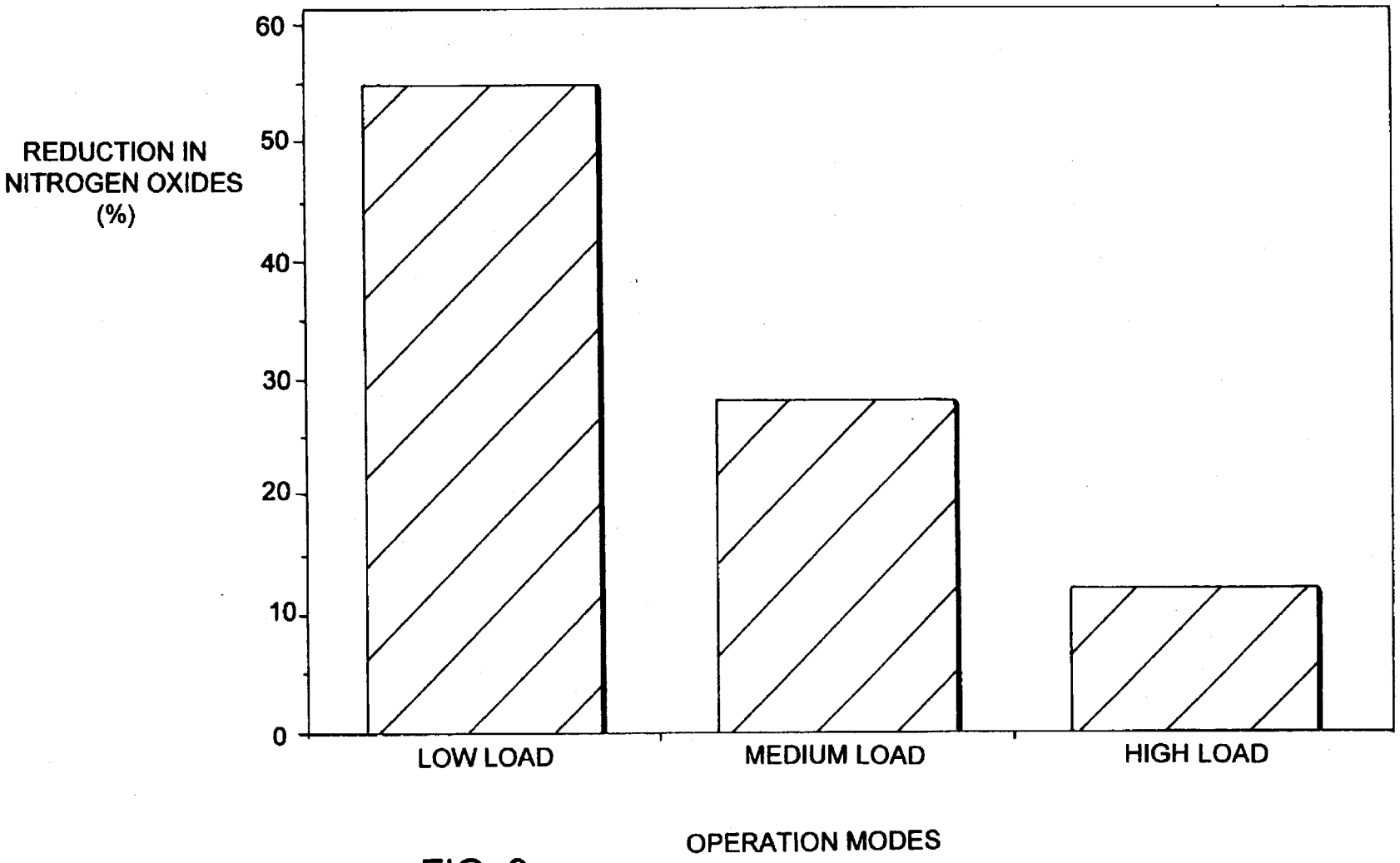
FIG. 9 Graphical representation of the effects of the additive on the reduction in nitrogen oxides during low load, medium load and high load engine operations.

The effect of the additive on nitrogen oxides is shown in FIG. 9. The additive produces the greatest effect at light load conditions (in excess of 50% reduction) but even at the highest load conditions the reduction in nitrogen oxides is greater than 10%. This decrease with load is probably an effect of incomplete combustion at the high loads and this is reflected in the efficiency graphs which also show a decrease. However, if the air-fuel ratio at the combustion zone is kept optimum (i.e. a well maintained engine) then it is believed that a greater reduction in nitrogen oxides will occur and also a greater efficiency of fuel with the use of the additive. It is therefore believed that if the additive is used for a long duration then the cleaning and cumulative effect of the additive will produce beneficial results.

5. Sulphur Trioxide

Figure 10:
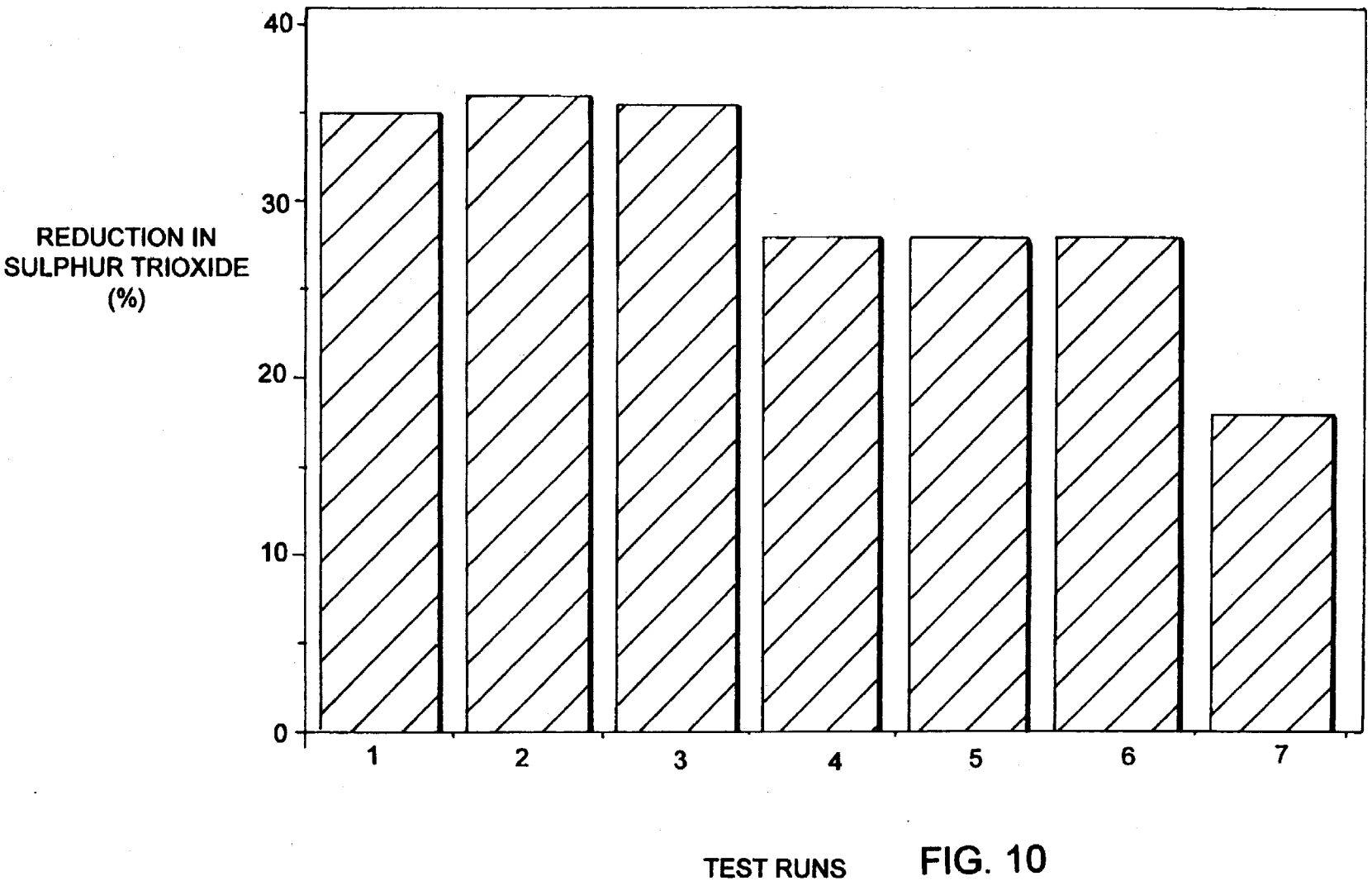
FIG. 10 Graphical representation of the effects of the additive on the reduction in sulphur trioxide in a continuous combustion chamber.

Sulphur trioxide tests were performed on a continuous combustion chamber. The results are presented in FIG. 10. Variations in the air-fuel ratio produced variations in the percentage reduction with the additive. At optimal conditions the reduction in sulphur trioxide was greater than 30%. It is believed that this reduction is due to competitive atomic reactions occurring in the flame zone, i.e. the additive actually manipulates the kinetics of combustion such that reductions in sulphur trioxide occur. The reduction is beneficial to industrial combustion systems since smaller amounts of sulfuric acid will be produced with the water vapor, always present in such systems.

EXAMPLE 2

In a general test of the fuel efficiency improvements that may be obtained with the invention a compression ignition engine was used. The fuel additive having the preferred formulation set out in Table 1 was mixed at a treat rate of 1:1,000 parts by volume with a commercially available diesel fuel for trucks, vans and cars.

Figure 11:
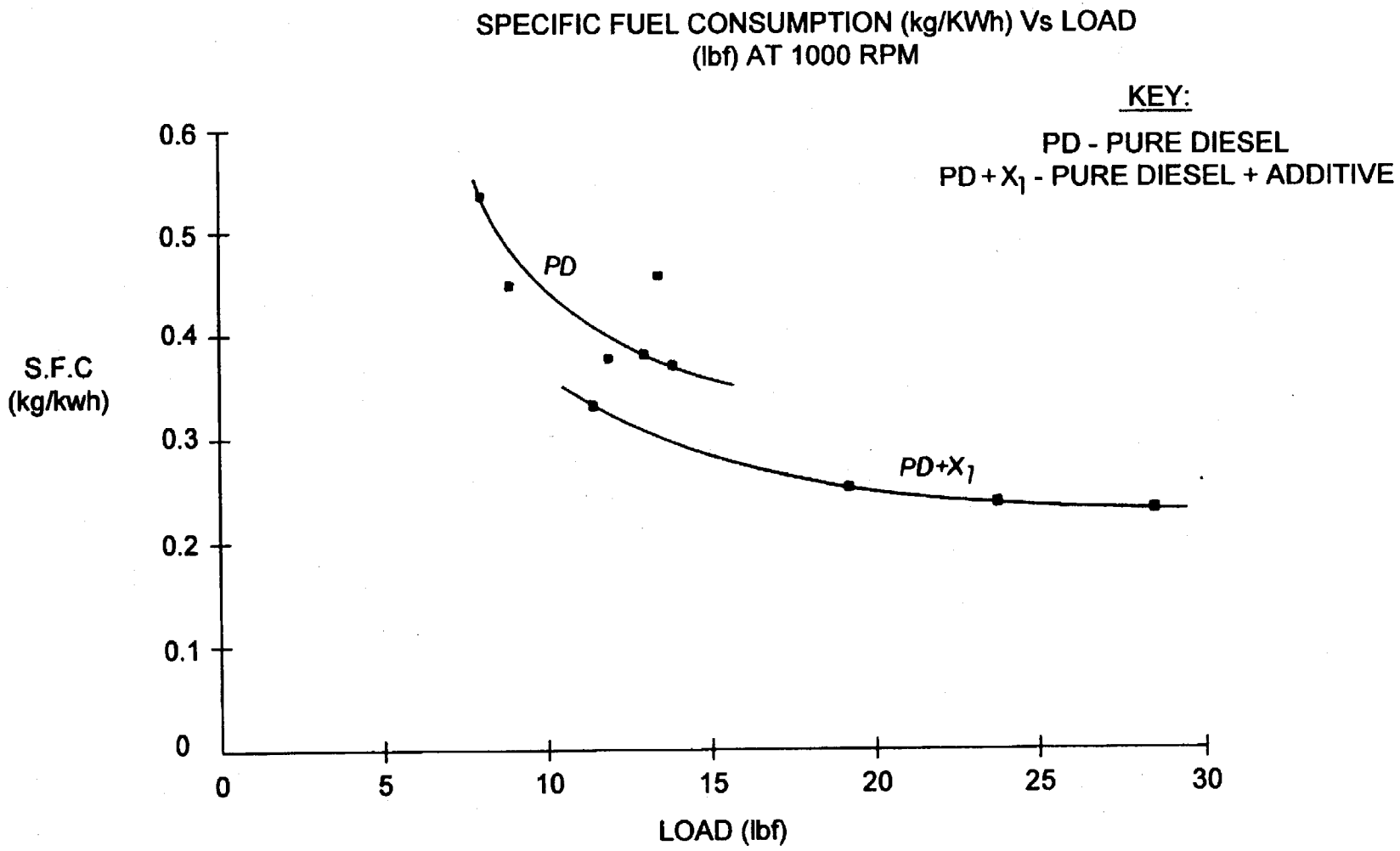
FIG. 11 Graphical representation of the differences in fuel consumption in an engine at 1000 RPM when using commercially available diesel fuel treated with the additive versus commercially available diesel fuel alone.
Figure 12:
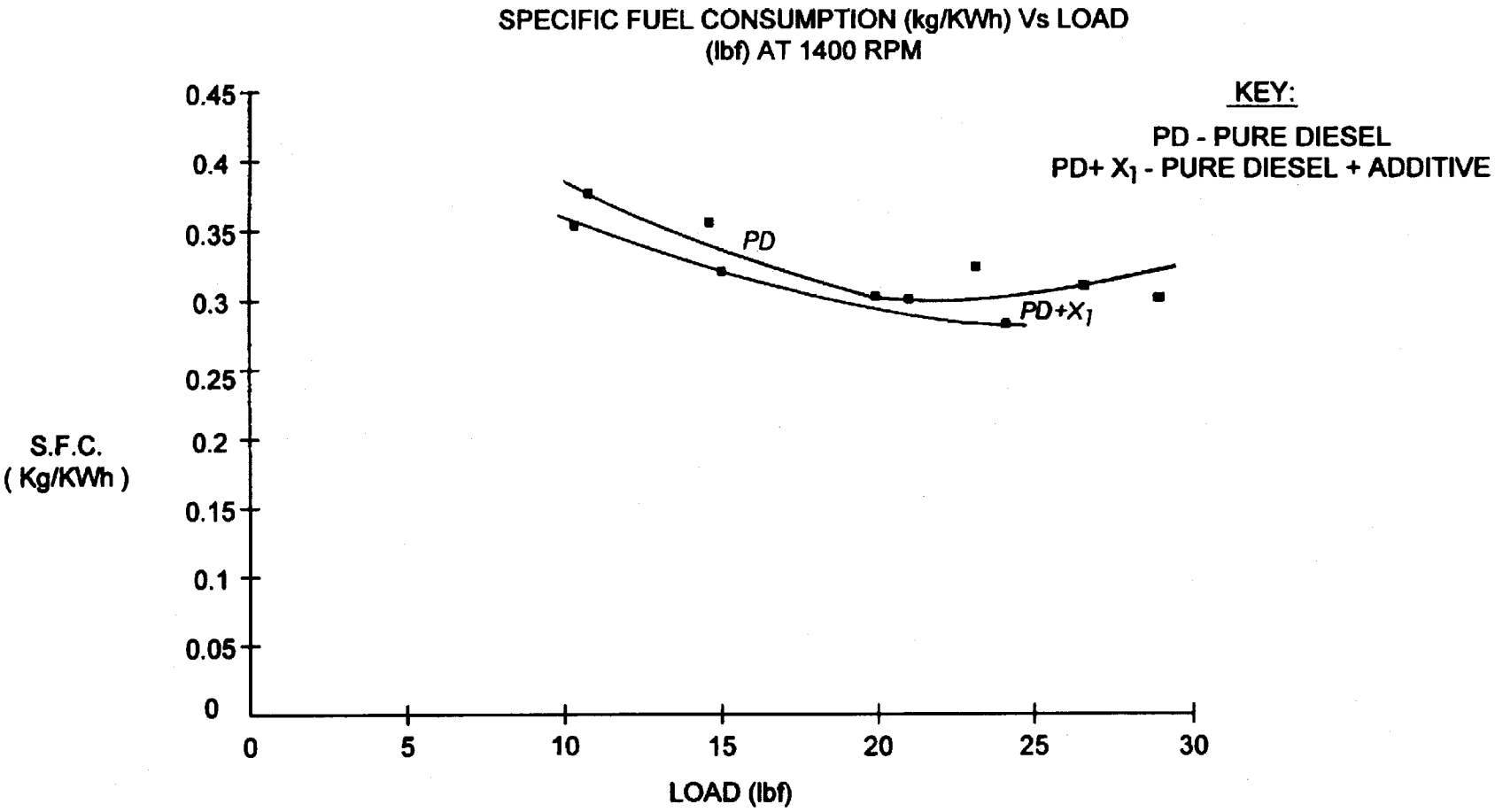
FIG. 12 Graphical representation of the differences in fuel consumption in an engine at 1400 RPM when using commercially available diesel fuel treated with the additive versus commercially available diesel fuel alone.

Tests were carried out at various load/speed cycles. It was noted that with the fuel containing the additive greater efficiency resulted as shown in the FIGS. 11 and 12. These tests also revealed that engine noise was reduced and the engine ran more smoothly with the additive fuel.

EXAMPLE 3

In a test involving two (2) city buses, the fuel additive having the preferred formulation set out in Table 1 and commercial diesel fuel was mixed at a treat rate of 1:500 parts by volume and was compared with neat commercial diesel fuel. The values in Table 2 below are direct average readings obtained from the two buses. Both the diesel only readings and the fuel additive added readings have been obtained over a 4 week period.

TABLE 2

| | HxCx (ppm) | A/F | $CO_2$ % | CO % | NOx (ppm) | Noise (dB) | Part. (mg) |
|---|---|---|---|---|---|---|---|
| | | BUS 1 - DIESEL ONLY | | | | | |
| Idling | 34 | 77.2 | 2.66 | 0.08 | 445.5 | 89.5 | 50.5 |
| Mid Rev | 15 | 67.2 | 3.12 | 0.02 | 655 | 110 | 35.2 |
| High Rev | 15 | 62.9 | 3.34 | 0.02 | 560 | 115.9 | 19.7 |
| | | BUS 1 - DIESEL + FUEL ADDITIVE | | | | | |
| Idling | 28 | 89.7 | 2.2 | 0.1 | 321.8 | 91.5 | 14.5 |
| Mid Rev | 15 | 75.2 | 2.77 | 0.03 | 435 | 108.8 | 11.3 |
| High Rev | 14 | 63.8 | 3.29 | 0.02 | 462.5 | 112.9 | 11.4 |
| | | BUS 2 - DIESEL ONLY | | | | | |
| Idling | 26 | 72.9 | 2.86 | 0.05 | 580 | 87.2 | 36.4 |
| Mid Rev | 20 | 71.8 | 2.91 | 0.04 | 600 | 107.5 | 35.8 |
| High Rev | 16 | 67.3 | 3.12 | 0.02 | 630 | 111.2 | 42.5 |
| | | BUS 1 - DIESEL + FUEL ADDITIVE | | | | | |
| Idling | 19 | 86 | 2.42 | 0.07 | 365.8 | 85.9 | 7.6 |
| Mid Rev | 12 | 72.8 | 2.86 | 0.03 | 435.5 | 106.2 | 12.1 |
| High Rev | 11 | 69.4 | 3.02 | 0.02 | 399 | 109 | 9 |

EXAMPLE 4

In this example, fuel efficiency tests involving eleven (11) commercial buses were carried out. The fuel additive having the preferred formulation set out in Table 1 was mixed with commercial diesel fuel at a treat rate of 1:500 parts by volume and was compared with neat commercial diesel fuel. The values in Table 3 below show the results of the fuel efficiency test.

TABLE 3

| BUSES | Diesel only (miles/gallon) | Diesel + Fuel Additive (miles/gallon) | % Improvement |
|---|---|---|---|
| 1 | 7.45 | 8.74 | 17.3 |
| 2 | 5.91 | 6.07 | 2.7 |
| 3 | 5.81 | 5.66 | −2.6 |
| 4 | 5.86 | 6.53 | 11.4 |
| 5 | 5.67 | 6.27 | 10.6 |
| 6 | 4.88 | 4.80 | −1.6 |
| 7 | 4.54 | 4.86 | 7.0 |
| 8 | 4.38 | 4.88 | 11.4 |
| 9 | 4.73 | 4.76 | 0.6 |
| 10 | 4.52 | 4.81 | 6.4 |
| 11 | 4.31 | 4.73 | 9.7 |
| Average | 5.28 | 5.65 | 7.0 |

EXAMPLE 5

Figure 13:
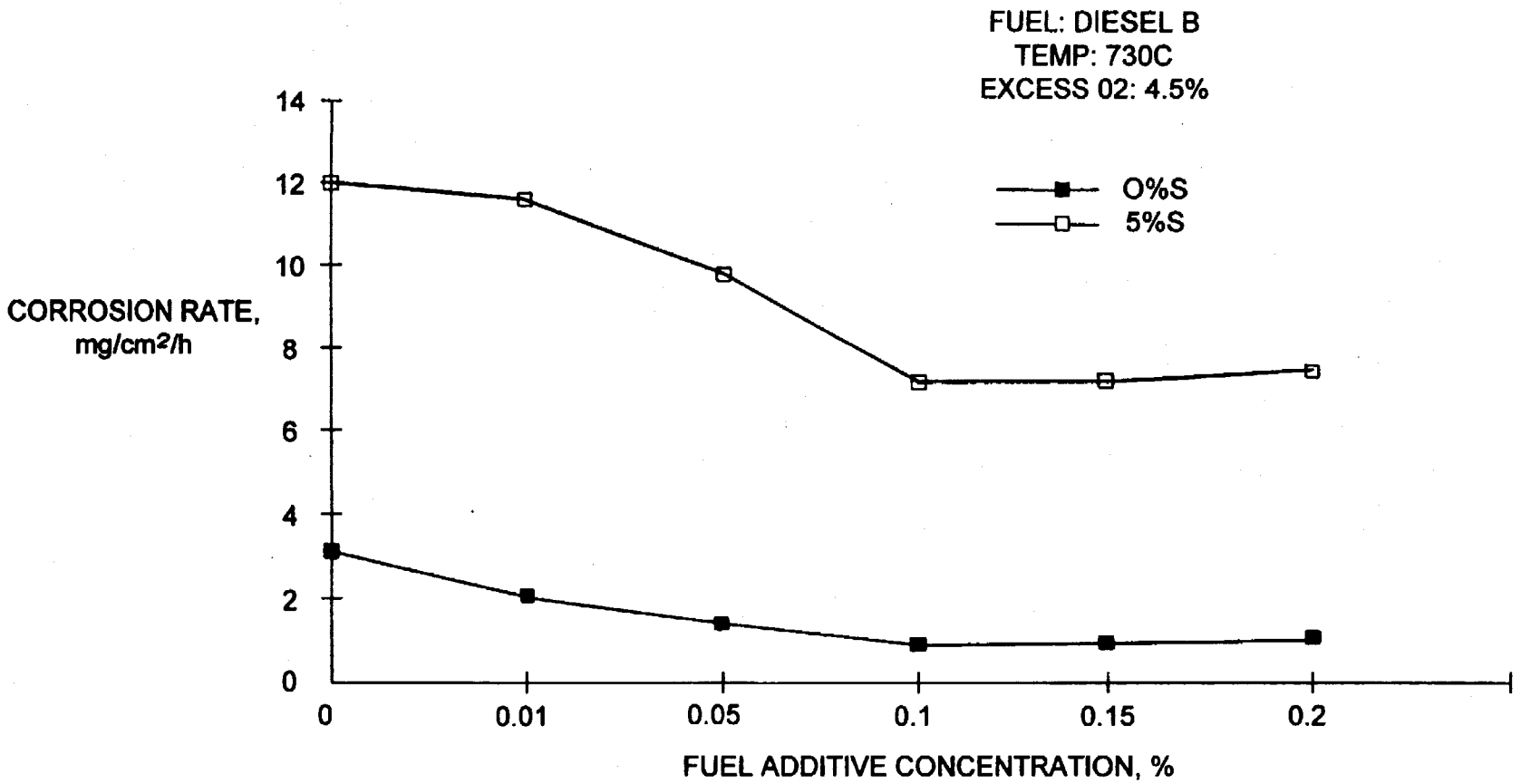
FIG. 13 Graphical representation of the effects of the additive on engine corrosion rates when sodium and vanadium are present in the fuel.

In this example, corrosion tests involving the fuel additive of the present invention were also performed. The fuel used in this example was, again, a mixture of the fuel additive having the preferred formulation set out in Table 1 and commercial diesel fuel which were mixed at a treat rate of 1:1,000 parts by volume. The effect of the present fuel additive on $SO_3$ suppression is shown in FIG. 13. FIG. 13 shows the benefit of reducing $SO_3$ concentration on corrosion rate. During these tests the corrosion rate decreased by up to 40%. FIG. 13 also shows the effect of the present fuel additive when sodium and vanadium but no sulphur is present in the fuel. Again, the additive is capable of reducing the corrosion rate. The present fuel additive inhibits the harmful reactions of sodium and vanadium and minimizes the formation of vanadium pentoxide; the most harmful oxide.

Figure 14:
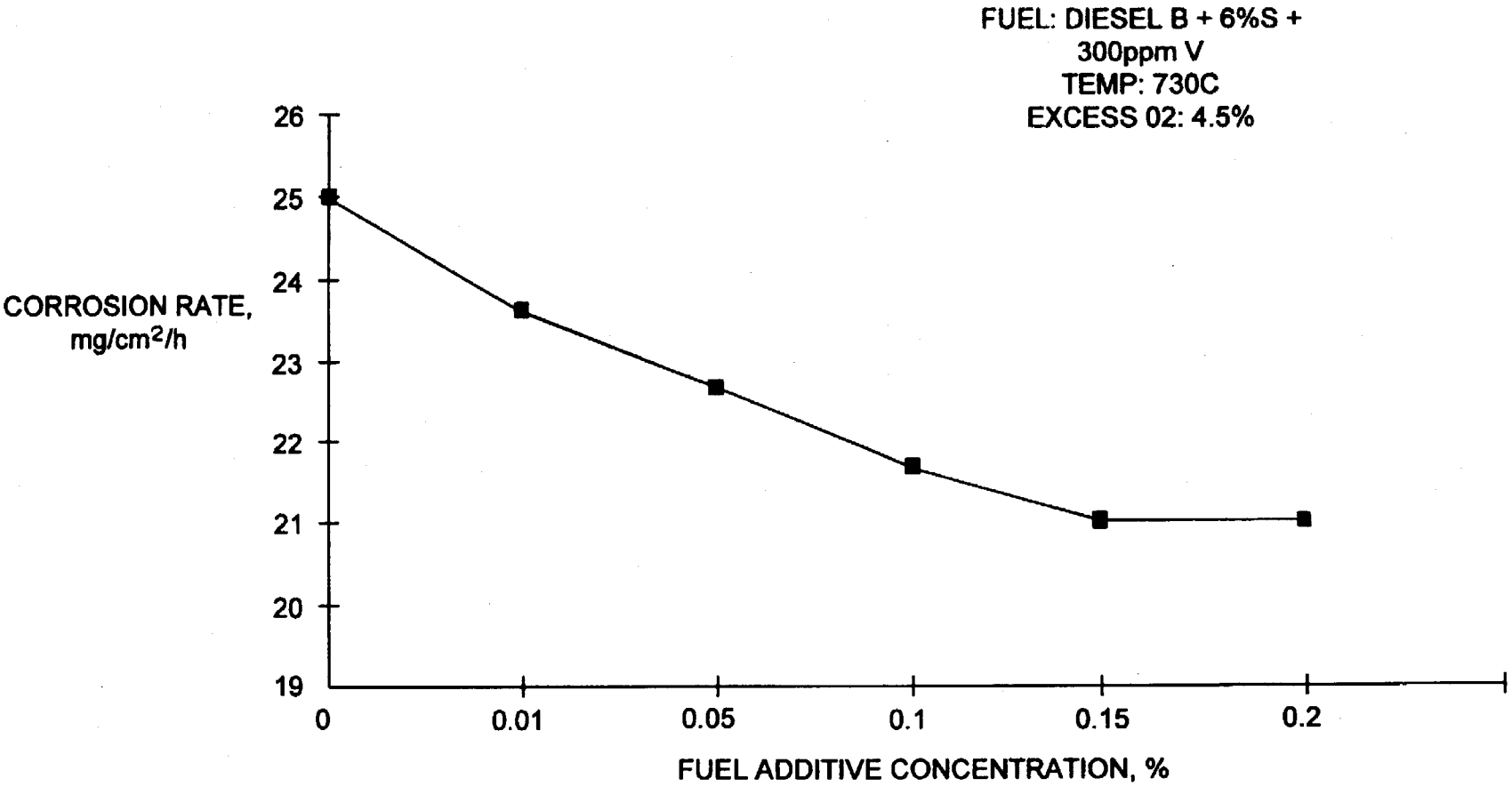
FIG. 14 Graphical representation of the effects of the additive on engine corrosion rates when sodium, vanadium and sulfur are present in the fuel.

The corrosion rate produced with the most harmful conditions is shown in FIG. 14. Again, the present fuel additive was shown to reduce corrosion rates and maintain it at a much lower level.

What is claimed is:

1. A method of improving the combustion efficiency and fuel economy, and reducing the amount of harmful pollutants formed in the combustion process of a combustion system, comprising the step of operating the system with a fuel composition which includes a fuel additive, the additive comprising a liquid solution of from 1 to 20% by volume of the additive, of at least one aliphatic amine selected from the group consisting of diamines and diamine and monoamine combinations; from 2.5 to 20% by volume of the additive of, at least one aliphatic alcohol; and at least one paraffin having a boiling point no greater than 300° C., wherein said paraffin is present in at least 40% by volume of the additive; said aliphatic amine and said aliphatic alcohol having boiling points less than that of said paraffin.

2. The method of claim 1 wherein the monoamine is a compound selected from the group consisting of diisobutylamine, isopropyl amine and tertiary butylamine.

3. The method of claim 1, wherein the fuel additive further comprises an ethyl amyl ketone.

4. The method of claim 1, wherein the fuel additive further comprises n-hexane.

5. The method of claim 1, wherein the fuel additive further comprises 2,2,4-trimethyl pentane.

* * * * *